United States Patent [19]

Turner

[11] Patent Number: 5,013,048

[45] Date of Patent: May 7, 1991

[54] GAME

[76] Inventor: Roy G. Turner, 322 Titirangi Road, Titirangi, Auckland, New Zealand

[21] Appl. No.: 476,684

[22] Filed: Feb. 8, 1990

[30] Foreign Application Priority Data

Feb. 16, 1989 [NZ] New Zealand ..... 228005

[51] Int. Cl.[5] ..... A63F 3/04

[52] U.S. Cl. ..... 273/242; 273/254; 273/256; 273/308

[58] Field of Search ..... 273/250–254, 273/249, 256, 308, 243, 242

[56] References Cited

U.S. PATENT DOCUMENTS

| | | | |
|---|---|---|---|
| 1,745,946 | 2/1930 | Murray | 273/308 |
| 3,223,420 | 12/1965 | Turner | 273/253 |
| 4,049,276 | 9/1977 | Hole | 273/252 |
| 4,093,235 | 6/1978 | Barry | 273/256 |
| 4,109,918 | 8/1978 | Mele et al. | 273/243 |
| 4,890,844 | 1/1990 | Weiss | 273/249 |

FOREIGN PATENT DOCUMENTS

| | | | |
|---|---|---|---|
| 915550 | 1/1963 | United Kingdom | 273/254 |

*Primary Examiner*—Benjamin Layno

*Attorney, Agent, or Firm*—Young & Thompson

[57] ABSTRACT

In its preferred form the present invention provides a board, skill or social interaction game which in normal use simulates world travel, including a board having two zones marked thereon, a number of cards and a number of playing pieces. Players score points by moving playing pieces on the first zone, using resources and opportunities, represented by cards, acquired by movement of a further playing piece on the second zone and an exercise of chance or skill. This exercise preferably includes identification of the geographical location of a place of tourist significance or other tourist attraction depicted on one face of cards.

5 Claims, 2 Drawing Sheets

FIG.3a

QUIZ CARD

Question 1 (for $400)
The colours of the Icelandic flag are Red, White and Blue - True or False?

Question 2 (for $800)
In what country is Sun Moon Lake located?

Question 3 (for $1000)
What is the oldest continuously populated city in the world?

23

FIG. 3b

ANSWERS

1. True

2. Taiwan

3. Gaziantep - this city in Turkey is estimated to have been continuously settled since 3650 BC.

23

FIG.2a

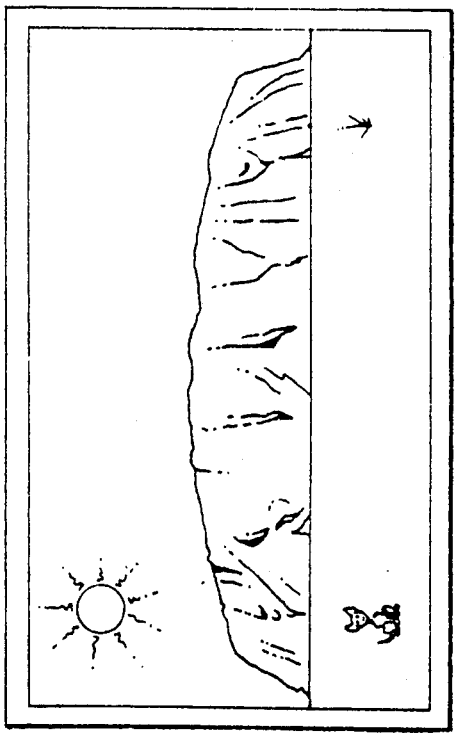

FIG.2b

TOURIST DESTINATION

Country: Australia
State / Province: Nth. Territory
Place: Ayers Rock

POINTS VALUE
8

Points are valid upon arrival at:
Adelaide or Darwin
and upon payment respectively of:
$200 or $200

World Location: Australia and Pacific

GAME

FIELD OF THE INVENTION

The present invention relates to games, and in particular to board, skill and social interaction games.

SUMMARY OF THE INVENTION

It is an object of the present invention to go at least partway towards providing a novel and improved game, or at least to provide the public with a useful choice.

In one aspect the present invention provides a game for a plurality of players, including:

a board having a zone marked with spaces, markers which in normal use are moved within said zone on said board, a resource, and rules which in normal use govern the use of said board, markers and resource;

wherein in accordance with said rules, the objective of players is to score points;

points are scored by a player by a combination of movement of a marker on the board and possession by said player of said resource;

and said resource can be obtained by players by means including visual identification of the subject represented by a picture.

Preferably the resource comprises a set of cards, wherein said cards each include a picture on one face thereof, and said cards can be obtained by players by means including identification of the subjects represented by the pictures on one face of the cards.

Preferably the pictures represent geographical locations, and in accordance with the rules, a player can obtain said cards by identification of the geographical locations from the pictures on one face of the cards.

Preferably the game further includes a form of game money.

In another aspect the game includes two zones marked with spaces on a board, wherein the objective of players is to score points, points are scored by a player by a combination of movement of a marker in a first said zone and possession of resources, and the extent of movement of said marker and the quantity of resources possessed by a player is determined at least in part by the movement of a second marker in the second said zone, and wherein the movement of the second marker in the second zone is at least in part determined by random selection means.

BRIEF DESCRIPTION OF THE DRAWINGS

FIG. 2: illustrates the front (a) and rear (b) faces of a first card of the present invention FIG. 3: illustrates the front (a) and rear (b) faces of a second card of the present invention.

Figure 1:
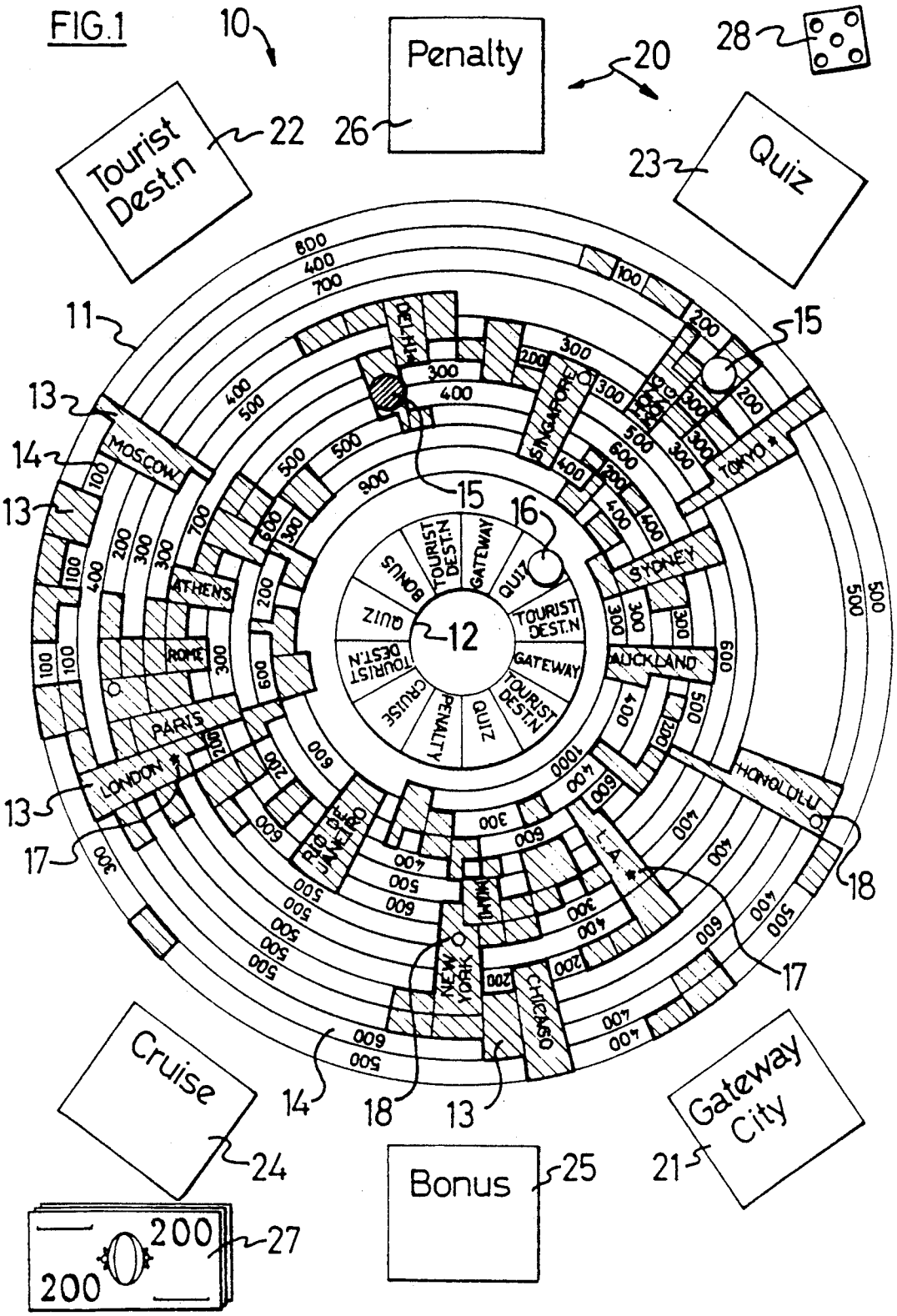
FIG. 1: schematically illustrates a simplified version of the board and pieces of the present invention.

The game of the present invention in its preferred form is intended for play by two to four players or teams, and involves the use of skill and knowledge to score points within a preset time limit. The preferred game simulates world travel.

As shown in FIG. 1, the board 10 is divided into two zones 11 and 12, within which the pieces move. The outer, annular zone 11, or Destination board, is a schematic representation of the world, on which are marked a number of cities 13 in an arrangement based on their relative importance with regard to tourism, and their geographic locations. The cities marked on the Destination board 11 are preferably "Gateway" cities commonly used by tourists as access points by which tourist attractions are commonly reached, and are interconnected by arcuate pathways 14 which represent air routes between such cities. The size and shape of each city 13 on the Destination board 11 is a function of the number of air routes 14 connected with it and the relative geographical location of other cities 13 to which it is linked. As shown the Destination board 11 is conveniently arranged in a form approximately corresponding to a map of the world centering on the South Pole, as this provides a larger "northern hemisphere" region on the board, and allows the greater importance of the northern hemisphere (in terms of tourism) to be accurately reflected in the relative number and size of the city areas 13. This arrangement also allows tourist routes around the world in an east-west direction to be represented as continuous rings, rather than leaving on one side of the board and returning on the other.

One counter 15 is provided for each player or team of players to move on the Destination board 11, in the manner detailed below.

The inner zone 12 of the board 10, or Resources board, comprises a looped track around which a single counter 16 is moved by each player in turn. The Resources board 12 is divided into a number of spaces, and the number of spaces moved by each player is preferably determined by random selection means, such as a die 28, for example. Upon landing on any space on the resources board, a card 20 of the type indicated is drawn by the player, and by this means resources may be gained or lost. These resources preferably include a form of money or credit note 27, and are used by the players in moving and acquiring points on the Destination board 11, as described below. The cards 20 are of six types:

1. Gateway City Cards 21—represent those cities 13 which are identified on the Destination board, and represent major tourist gateways to a country.

2. Tourist Destination Cards 22—represent cities, places, or events of tourist interest, which can be reached by making a side trip from a Gateway city 13. They are not marked on the Destination board 11, but are considered to be linked to a Gateway City 13.

As illustrated in FIG. 2, each of the cards 21 and 22 includes a picture on the front face (a) and information on the rear face (b), both the picture and the information relating to the same tourist attraction. The information on the face (b) details the name of the country in which the attraction is located, the specific city or place name, a points value, and the name of one or more Gateway cities 13 at which the points can be "validated", or added to a players score. Cards relating to tourist attractions or Gateway cities 13 located in the United States of America, Canada or Australia may additionally include the name of the specific state or province in which the attraction is located, and Tourist Destination Cards 22 preferably also include a monetary cost, which relates to the cost of travel from the Gateway city 13 mentioned on the card to the specific location of the attraction.

When a player moves the counter 16 to either a "Gateway" space or a "Tourist Destination" space on the Resources board 12, a card is selected from the appropriate stack, and without viewing the information on face (b), the player must attempt to state the location of the tourist attraction illustrated on face (a). If the country is correctly stated the player may keep the card—if incorrectly stated, the card is discarded. If the specific place name is also correctly stated along with the country name, an additional reward may be given. Once a player is in possession of one or more cards 21 and 22, he or she can gain the stated number of points by moving on the Destination board 11 to the mentioned Gateway city 13, and paying any requisite monetary fee.

3. Quiz cards 23—as shown in FIG. 3, these cards have a number of questions printed on one face (a) with a reward value associated with each, and the correct answers to the questions printed on the other face (b). In normal use when a player lands on the appropriate space on the Resources board 12, a card 23 is chosen and a question is selected by that player according to its level of difficulty, the question is then read out, and the player attempts to answer it. If the question is correctly answered, the stated reward is given.

The reward is preferably in the form of "money" or credit 27, which may then be used in movement on the Destination board 11, or to pay for validation of Tourist Destination cards 22. Each of the air routes 14 on the Destination board 11 is marked with a figure, and this comprises the amount which must be paid to travel that route. Similarly travel from one city 13 to an adjacent city 13 will cost a preset amount. In this way the distance travelled by a player on the Destination board 11 is governed by success or failure on the Resources board 12.

4. Overland and Cruise Cards 24—detail a number of points which can be obtained on payment of a given fee at a given city 13, representing cruises or tours which are possible from that city. Optionally, one or more cards 24 could also provide a move from one city 13 to another. The cards 24 are similar to Tourist Destination cards 22, but do not require an exercise of intellect to be obtained by a player.

5. Bonus Cards 25—represent fortunate occurrences by which a player may gain a reward.

6. Penalty Cards 26—represent unfortunate occurrences by which a player may incur a penalty.

In normal use, each player or team of players moves in turn, first moving the counter 16 on the Resources board 12 to determine a type of card to be selected, then either claiming the card in the case of a card 24, attempting to identify the picture in the case of a card 21 or 22, attempting to answer a question in the case of a card 23, or accepting the fate indicated in the case of a card 25 or 26. Finally, the player or team may optionally move the appropriate counter 15 on the Destination board from one city 13 to another, paying any requisite fees, and thereby validate points from cards 21, 22 or 24 acquired in the meantime.

A number of other rules and variants may be added to the basic system described above, to facilitate smooth play.

The positions of pieces on the Destination board 11 and Resources board 12 at the commencement of a game are preferably determined by the choice of the teams or players, but alternatively could be determined randomly or be specified in the rules. For example, the rules could specify that all pieces 15 on the Destination board must commence the game from the city 13 nearest to the actual location of the players.

A player may be appointed to control distribution of cards and money, and possibly also to act as arbiter in disputes.

A number of cards 21, 22 and/or 24 may be given to each player at the start of the game, along with an amount of money 27, to reduce any initial delay in activity while players gather resources. The amounts may vary, but preferably in a game where, as shown in FIG. 1, the "cost" of travel between London and New York is 500 units and other costs are proportionate, the amount of money 27 initially allocated is approximately 2000 units.

Travel Insurance cards may also be provided as a defence against some penalties, such as those incurred by drawing a penalty card 26.

Some cities 13 may be linked by "direct long-haul flights" which are not represented by air routes 14, but rather by colour codes or the like. For example, London and Los Angeles may both bear a marking 17, and New York and Honolulu both bear a different marking 18, which would allow direct travel between London and Los Angeles or New York and Honolulu for fixed cost.

Direct travel between, for example, London and Honolulu would however not be permitted as the markings they bear are different.

Preferably, players may move any distance on the Destination board 11 permitted by their finances within a single turn, but must end their turn at a Gateway City 13 if they wish to validate points in that city. If a number of cards 21 and/or 22 are acquired which relate to the same city 13, only one can be validated in any one turn.

Optional rules may be provided to increase the level of difficulty of the game. For example, players may be required to name the specific location of a scene illustrated on a card 21 or 22 in order to acquire it, rather than the country it is in. Alternatively, players could be required to name the specific state in which United States, Canadian or Australian scenes are located.

Bonus points might also be allocated for achieving particular subsidiary goals. Cards 21, 22 or 24 might be divided into sub-groups of related cards, and bonus points might be given for validating a preset number of cards from a particular group.

Other rules may also be provided as required or found desirable.

It will be appreciated that many variations might be made in the pieces, rules or board of the game described above, within the general spirit and scope of the invention.

While it is seen as preferable at present to have a Resources board 12, the random selection of cards could be done by other means. The cards could be placed in numbered piles, and a pile selected by each player in turn—by means such as the roll of a die 28. Alternatively, a number of cards of each type could be shuffled together in a single stack, and each player simply draws off the top card in turn.

It is preferable that the Destination board 11 represents the world, as illustrated, but it will be appreciated that the principles of the game could be applied to games set in a specific country or area, or in a fictional setting, and the Destination board could be altered to suit. Similarly, while the questions on the Quiz cards 23 preferable relate to tourism as illustrated in FIG. 3, questions relating to any of a number of subjects could be used instead, or alternatively mathematical or other tests of skill, luck or memory, depending on the overall theme of the game.

Other variations are also possible within the general spirit and scope of the invention, as generally characterised by the following claims:

1. A game for a plurality of players, in normal use providing a simulation of world travel, including a board having a zone marked with spaces, markers which in normal use are moved within said zone on said board, a plurality of resource cards, and rules which in normal use govern the use of said board, markers and resource cards; said zone comprising a representation of the world; said spaces being arranged in a polar coordinate pattern and representing parts of the world; and wherein said spaces are arranged to substantially correspond with the arrangement of said parts of the world when represented by a South Pole centered polar coordinate map, the center of said zone being equivalent to the South Pole nd the outer perimeter of said zone being equivalent to the North Pole; whereby said zone provides a representation of the world having a proportionately larger northern hemisphere, and permitting continuous arcuate movement within and between said spaces in an East/West direction and radial movement within and between said spaces in a North/South direction; said resource cards corresponding to said spaces, wherein on the obverse side of each of said resource cards is a picture representing a scene of a part of the world to be identified, said scene associated with a said space representing said part of the world, on the reverse side of each of said resource cards is the identification of said scene and a point value.

2. A game as claimed in claim 1, wherein said points are scored by a player by a combination of movement of a marker on the board to a plurality of designated spaces and possession by said player of said resource card; each of said plurality of designated spaces comprising a space associated with a said scene to be identified by the player to obtain said resource card; and wherein opportunities for said visual identification occur at intervals over the course of play.

3. A game as claimed in claim 2, further including a form of game money, wherein the distance and rate of movement of said marker within said zone is proportional to the amount of said game money expended by a player; and in accordance with said rules each player is given a plurality of opportunities over the course of play to move said marker and may at each said opportunity optionally decide to move said marker or decide to refrain from moving said marker; and wherein each said player must individually select a route of movement and a timetable for movement of said marker within said zone to said plurality of designated spaces.

4. A game as claimed in claim 3, further including a fund of questions, wherein in accordance with said rules a player can obtain said game money by correctly answering a said question.

5. A game as claimed in claim 4, further including a second zone defined on a board and marked with spaces, on which at least one marker can be moved in accordance with said rules; at least one said space being marked to relate to said questions and at least one marked to relate to said resource; so that movement of said at least one marker to a said space in the second zone can in accordance with said rules identify a fund of said questions eligible to be answered by a player, or a part of said resource eligible to be obtained by a player; movement of said at least one marker being determined by random selection means.

* * * * *